US005346066A

United States Patent [19]

Jones

[11] Patent Number: 5,346,066

[45] Date of Patent: Sep. 13, 1994

[54] KEY SAFE

[76] Inventor: Ray A. Jones, 9421 Glen Ridge Dr., Laurel, Md. 20707

[21] Appl. No.: 739,415

[22] Filed: Aug. 2, 1991

[51] Int. Cl.[5] ..... A47G 29/10

[52] U.S. Cl. ..... 206/457; 70/456 R; 206/37.1; 109/45; 446/475

[58] Field of Search ..... 70/456 R–458; 109/45; 206/37.1, 457; 220/478, 672, 675; 449/30, 27, 29, 4, 3; 446/76, 475; D3/207–212; D99/35–38; D21/59, 109; D30/108, 160

[56] References Cited

U.S. PATENT DOCUMENTS

| | | | |
|---|---|---|---|
| 8,321 | 5/1875 | Ferguson et al. | D99/37 |
| 11,358 | 8/1879 | Kyser et al. | D99/37 |
| 968,536 | 8/1910 | Brucklacher | 109/50 |
| 1,743,563 | 1/1930 | Montuori | 70/456 R |
| 3,119,249 | 1/1964 | Goldstein | 70/456 R |
| 3,127,918 | 4/1964 | McElvain . | |
| 3,407,636 | 9/1966 | Kovacevic . | |
| 3,587,262 | 6/1971 | Kaye . | |
| 3,877,269 | 4/1975 | Dehart . | |
| 4,048,824 | 9/1977 | Blackmon | 70/456 R |
| 4,491,994 | 1/1985 | Youssef | 449/4 |
| 4,531,635 | 7/1985 | Cleveland . | |
| 4,571,967 | 2/1986 | Jacobsen . | |
| 4,677,835 | 7/1987 | Almblad . | |
| 4,800,822 | 1/1989 | Adkins | 109/59 R |
| 4,901,462 | 2/1990 | Wrigley . | |
| 4,905,878 | 3/1990 | Lovinger . | |
| 5,005,336 | 4/1991 | Bloom | 206/457 |
| 5,169,024 | 12/1992 | Rinkewich | 220/675 X |

FOREIGN PATENT DOCUMENTS

| | | | |
|---|---|---|---|
| 2523 | of 1829 | France | 449/29 |

OTHER PUBLICATIONS

The Gift and Art Buyer, Feb., 1959, p. 213, Bee Bank No. 1900; D99–38.

Dorothy Sterling (Sterling), "Insects And The Homes They Build", Doubleday & Co., Inc., Garden City, N.Y., pp. 47–50 and 57–63 (1954).

Out Water; Plastics/Industries 1990 catalog p. 77.

Kite, Pat; Live and Let Live, National Gardening Jul., 1990.

*Primary Examiner*—Peter M. Cuomo
*Assistant Examiner*—Suzanne L. Dino
*Attorney, Agent, or Firm*—Stevens, Davis, Miller & Mosher

[57] ABSTRACT

A key safe for hiding a key out-of-doors. The key safe is an article having a facade that resembles a nest of an insect. Preferably the nest resembles the nest of a stinging insect and more preferably the nest of a mud dauber wasp. This device is composed of a hinge and a facade defining an interior for storing a key. The key safe may be secured to a branch of a tree, a shrub, a building, fence, deck, dock, recreation vehicle etc., generally in places where an insect is likely to build such a nest.

20 Claims, 4 Drawing Sheets

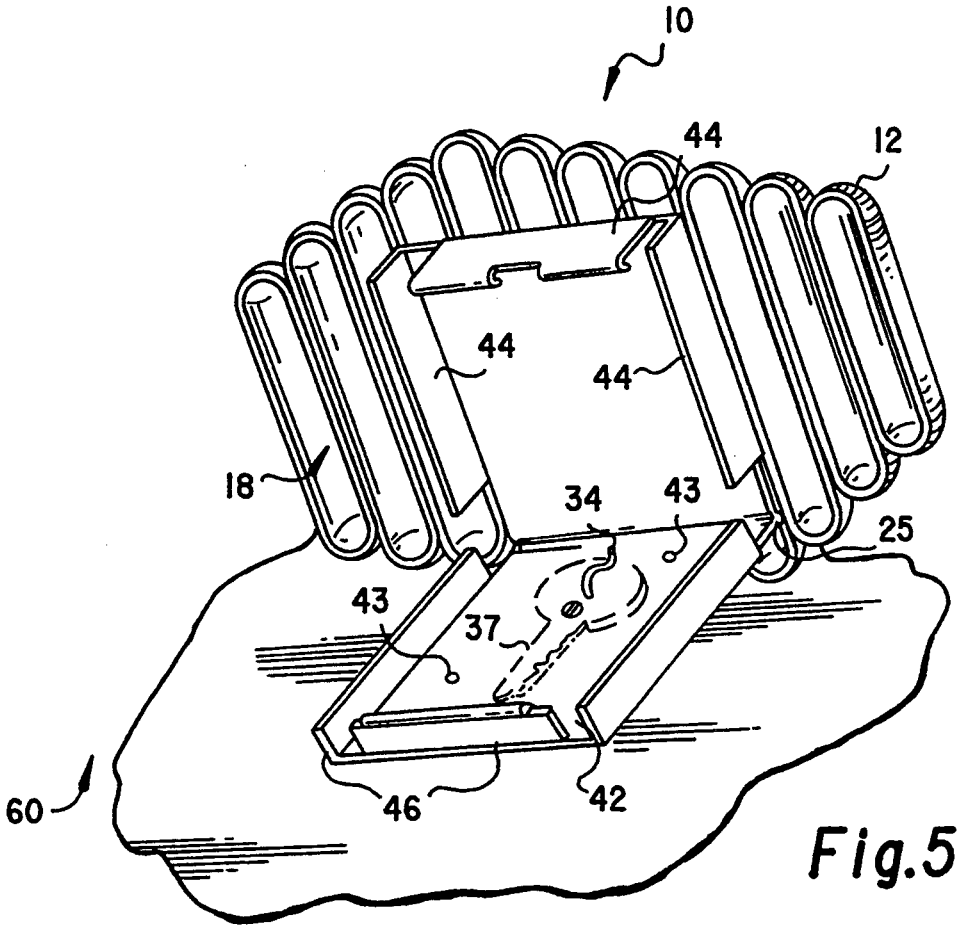
Fig.5
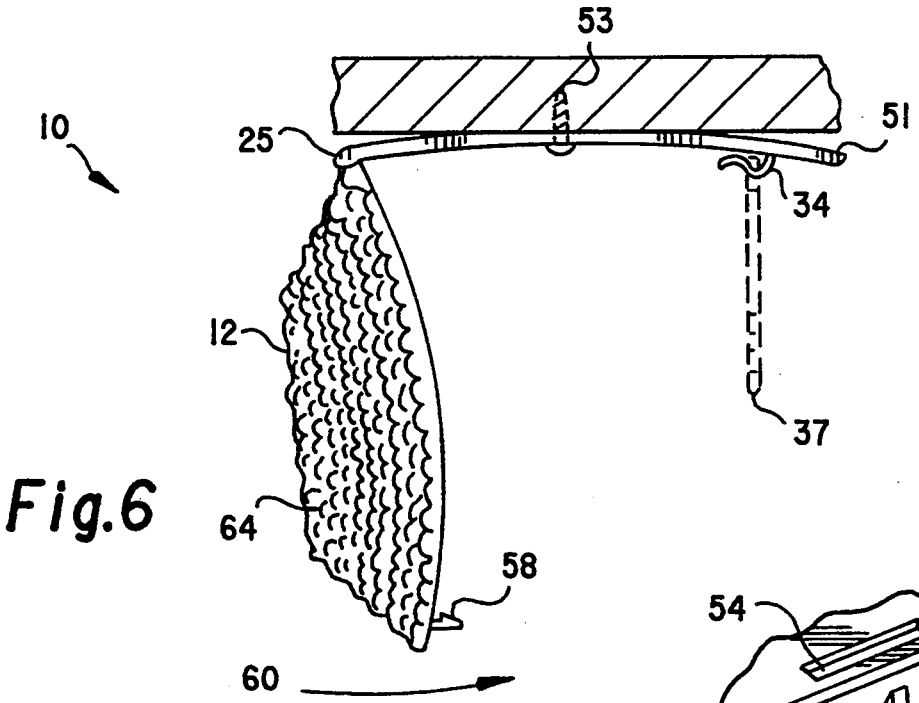
Fig.6
Fig.7
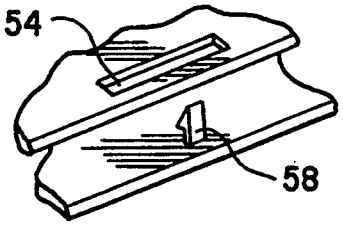

KEY SAFE

FIELD OF THE INVENTION

This invention relates to an article for hiding keys.

In particular the invention relates to key safes resembling the nest of a stinging insect.

BACKGROUND OF THE INVENTION

A variety of key holders and key carrying cases are known which provide a convenient, and compact means for carrying a plurality of keys or spare keys. These key holders and carrying cases contain clips, clasps, and loops for retaining keys against the surface of or within recesses in the body of the holder or case. These devices are intended to provide easy access to a single key which is used daily or on a regular basis to gain access to a structure such as an apartment or a house. However, as disclosed in U.S. Pat. No. 4,531,635 it is often desirable to hide a key that is readily accessible in the event that the key being used on a regular basis is lost or becomes unavailable. The utility of a well camouflaged yet easily accessible hiding place for a spare key is unquestioned. However a key hidden under a door mat or on top of a door ledge invites crime; a key hidden in a magnetic box is suitable for attachment to a metal frame but may be easily detected. A luggage tag for hiding a key is described in U.S. Pat. No. 4,901,462. This device may be customized by monogramming or by allowing the owner to weave yarn in a mesh body of the device. However, the device is not intended for exposure to the elements and the device invites inquiry and may even provoke an on-looker to handle the device. Such an inquiry may reveal the hidden contents. Another device is disclosed in U.S. Pat. No. 4,531,635. This device is intended for outdoor use and resembles the shape of a stone or rock. The device has a flat bottom surface and an internal storage area accessible through a bottom sliding cover. However, such a device may be discarded and inadvertently picked up and disposed of defeating the purpose of the device. Additionally, the device may be covered with snow, grass-clippings, leaves and/or overgrown grass preventing identification and, therefore, use.

The object of the present invention is to provide a key safe having a facade that resembles a natural object and which does not invite inquiry and is large enough to retain one or more keys.

Another object of the invention is to provide an owner of a key with the ability, at the owner's discretion, to give the key safe a distinctive look by removing pieces of a facade of the key safe.

SUMMARY OF THE INVENTION

The present invention relates to a key safe for hiding a key out-of-doors. The key safe is an article having a facade that resembles a nest of an insect. Preferably the nest resembles the nest of a stinging insect and more preferably the nest of a mud dauber wasp. This device is composed of a hinge and a facade defining an interior for storing a key. The key safe may be secured to a branch of a tree, a shrub, a building, fence, deck etc., out of the normal field of vision but in accessible places and in places where an insect is likely to build such a nest.

BRIEF DESCRIPTION OF THE SEVERAL VIEWS OF THE DRAWINGS

FIG. 5 is a perspective view of a second embodiment of the invention;

FIG. 6 is a side view of a third embodiment of the invention; and

FIG. 7 is a perspective view of the type of latch mechanism which may be used in the device of FIG. 6.

DETAILED DESCRIPTION OF THE INVENTION

Figure 1:
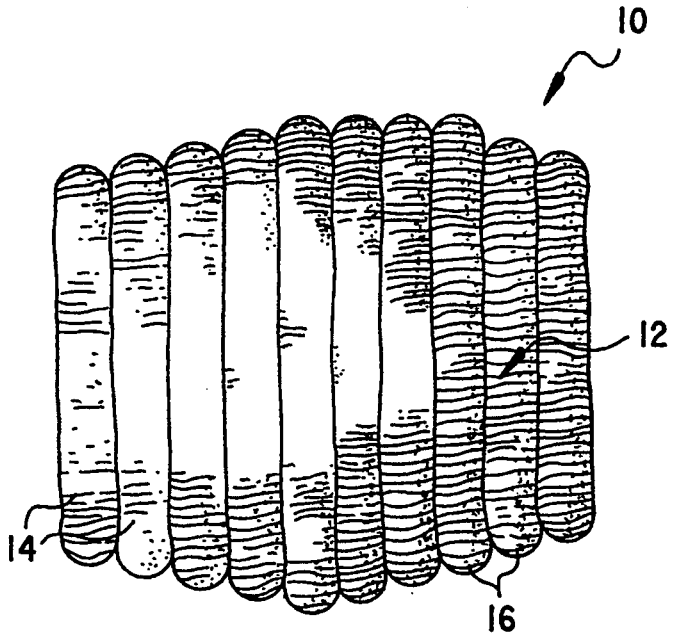
FIG. 1 is a plan view of the device mounted on a support structure showing the facade of the device.

FIGS. 1–4 show a first embodiment of the invention. The device shown is a key safe 10. In the first embodiment the face or facade of the device has the appearance of the nest of an insect. The nest may be the nest of a stinging insect such as the nest of a hornet or a wasp. Preferably the device 10 resembles the outside housing of a mud dauber's nest. FIG. 1 shows a key safe 10 having a facade 12 of a mud dauber's nest drawn to scale and with authentic detail. In this embodiment the facade is composed of a series of substantially parallel tubes 14, and each tube appears to be composed of a plurality of mud rings 16 formed one on top of the other. Tubes 14 deviate from parallel as such tubes would if produced by a mud dauber and as shown in FIG. 1.

Figure 2:
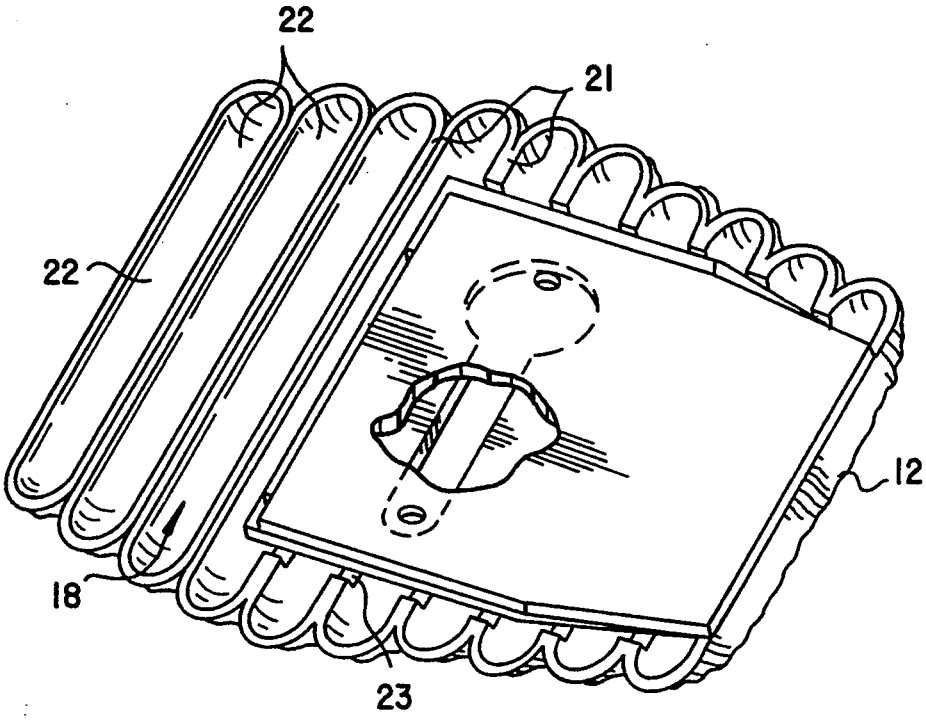
FIG. 2 is a perspective view of the reverse side of the facade of FIG. 1, having a hinge shown in the closed position.
Figure 3:
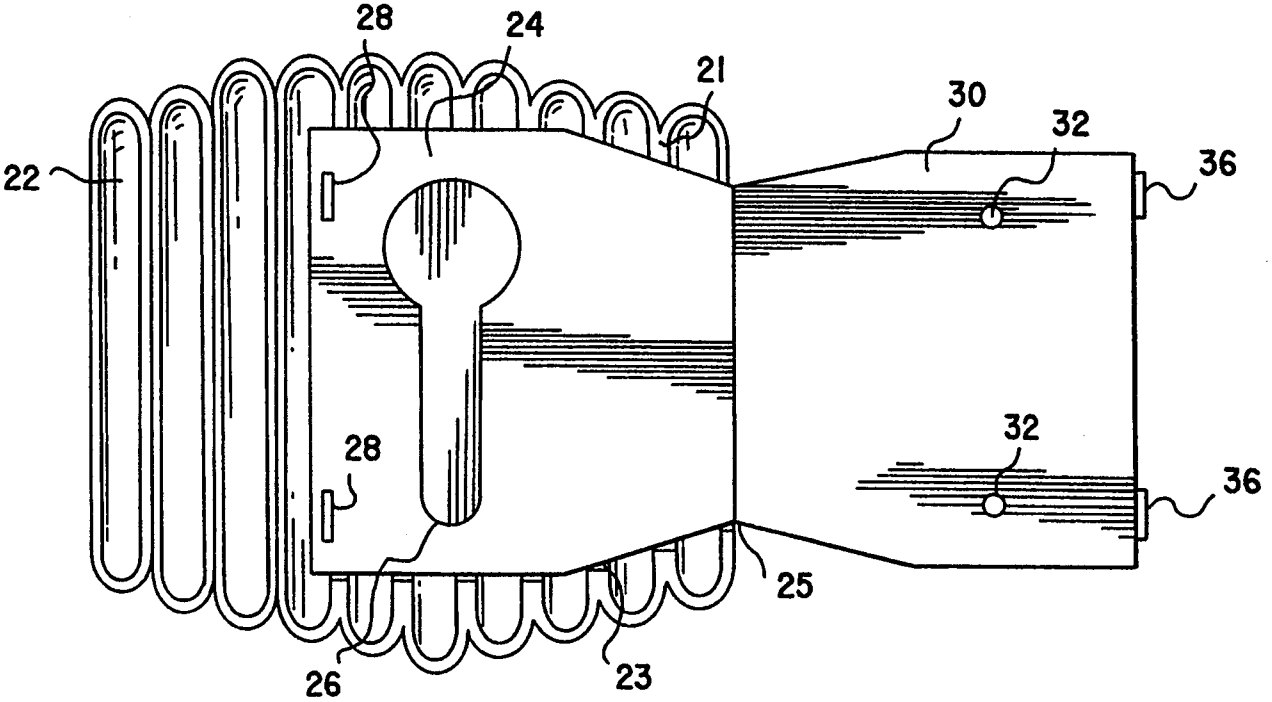
FIG. 3 shows the reverse side of the facade with the hinge in an open position.

As shown in FIG. 2 the reverse side 18 of facade 12 of FIG. 1 is hollow and resembles the interior of a mud dauber's nest. The interior of the device includes membranes 21 dividing and defining what would be the egg chambers 22 of the mud dauber's nest. Membranes 21 are not positioned throughout the interior of the device for reasons discussed below. As shown in FIGS. 2 and 3 positioned on edges 23 of the reverse side 18 of facade 12 is a first leaf 24 of a hinge 25. Preferably hinge 25 is a flat hinge.

Leaf 24 may have a recessed compartment housed in the hollow interior of the reverse side 18 of facade 12. Alternatively, and preferably, as shown in FIG. 3, a portion of leaf 24 has a cut-away 26 providing access to the interior or reverse side 18 of the facade. A key is stored in the hollow interior. A second portion of the leaf 24 contains spaced female closure members 28 which are small openings or slits as shown.

As shown in FIG. 3 hinge 25 includes a second leaf 30, which may be slightly smaller in dimension than leaf 24. The face of leaf 30 (FIG. 3) has two mounting holes 32 for receiving screws 33 and 35 (shown in FIG. 4) or other fastening devices for securing the key safe to a support structure, such as a joist or post of a wooden deck, the side of a house, a cement porch or even to the trunk of a tree, or a branch of a garden shrub. Preferably the top mounting hole will receive a hook 34 (FIG. 4) having threads 35. The hook is used to mount a key 37 as shown and the threaded hook 34 is used, in part, to mount key safe 10 to a support structure. Leaf 30 also includes spaced male closure members 36 as shown in FIG. 3.

Figure 4:
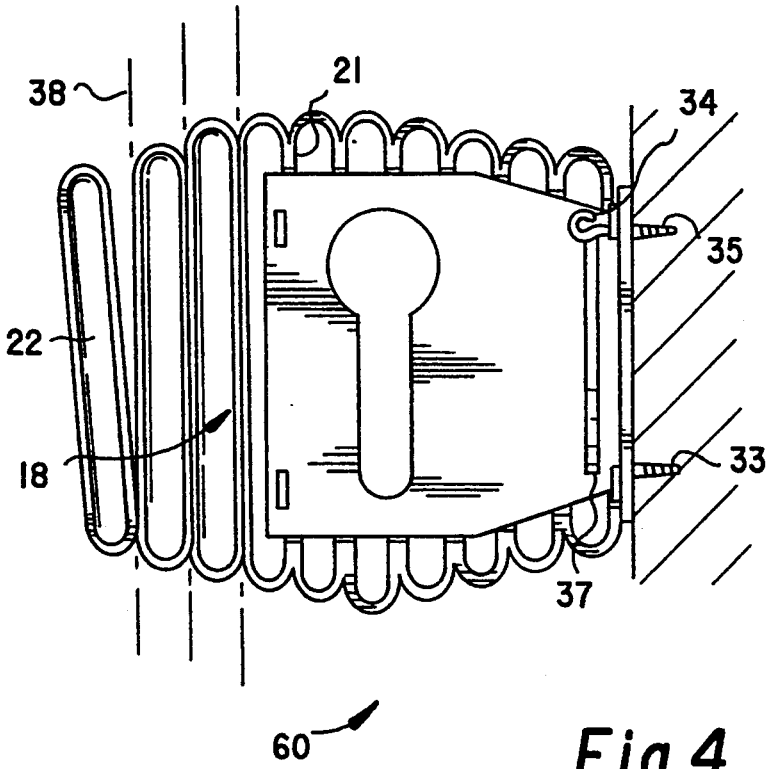
FIG. 4 is a side view of the device mounted to a support structure and in the open position and showing the reverse side of the facade of FIG. 1 with score lines and the partial removal of a portion of the facade.

By mounting leaf 30 to a support structure as shown in FIG. 4 a key 37 on hook 34 can be hidden from view by swinging the facade 12 so that the two leaves of hinge 25 contact one another. In this position, and by applying the proper force in the direction of arrow 60 shown in FIG. 4, female closure members 28 and male closure members 36 mate and become interlocked to maintain the key safe in the closed position shown in FIG. 1. A pulling force applied to the side of facade 12 not supporting a hinge will release the closure members revealing the key on hook 34.

The device 10 may be mounted vertically as shown in FIG. 4 with the hinge 25 positioned vertically relative to the ground. Alternatively, device 10 may be positioned horizontally so that hinge 25 appears at the top of the device. In this instance the facade is raised to reveal the hidden key. To prevent the key from falling and becoming lost in the shrubs or the ground below the device includes appropriately positioned hooks or clips. If the small object to be hidden, such as a key is made from an iron-containing metal a magnet can be fastened to a leaf to retain the small object. Additionally, other retaining structures are disclosed in the U.S. Pat. Nos. 3,127,918, 3,587,262 and 4,677,835 which patent disclosures are herein incorporated by reference.

As described above the device includes a plurality of substantially parallel tubular members 14. The tubular construction is seen in facade 12 as shown in FIG. 1 and in the reverse side 18 of facade 12 as shown in FIG. 2 by defining membranes 21. In view of this tubular construction an owner of the device may remove a tube or portion of a tube to distinguish his particular device from other mass marketed devices. The tubes may be cut away with a safety razor so long as the defining membrane 21 remains intact, thus preserving a side of facade 12. Alternatively, in manufacturing, score lines 38 can be made between tubular sections or through portions of the tubular sections for their easy removal by a purchaser of the device as demonstrated in FIG. 4. In this way the device can be tailored by a purchaser so that it does not resemble or look like the device of another.

By way of example only, the key safe 10 is constructed in a single piece, preferably by injection molding, of polyethylene, polypropylene or mixtures thereof. The flat hinge 25 is produced in association with the facade 10 during molding. Alternatively, the hinge may be made separately and constructed of polypropylene or PVC. Polypropylene flat hinges can be purchased from Outer Plastic Industries of Wood-Ridge, N.J. catalog part Nos. 103638 and 103639 as set forth on page 77 of the 1990 catalog. In such a construction leaf 24 is secured to the edges 23 of the reverse side 18 of facade 12 by a non-water soluble glue. Construction of the device will be dictated by economy.

A second, and preferred embodiment of the key safe is shown in FIG. 5. The elements of FIG. 5 identified by the same numbers used in FIGS. 1–4 are similar to the elements shown in FIGS. 1–4. Key safe 10 of FIG. 5 has a facade 12 and a reverse side 18. In this embodiment hinge 25 is located at the top of facade 12 and is positioned in the relative middle of facade 12. In this second embodiment facade 12 functions as a first leaf of hinge 25. Securing portion 42 of the key safe functions as the second leaf. The front face of securing portion 42 has two mounting holes 43 for receiving fastening members such as screws, and a hook 34, which is preferably S-shaped, as shown for retaining a key 37.

The reverse side or interior 18 of facade 12 includes side members 44 as shown. Securing portion 42 also has positioned thereon similar side members 46 resembling side members 44. In the closed position side members 44 are positioned adjacent to and outside of side members 46. By this construction the interior of the facade will substantially abut the structure supporting the key safe and facade 12 will hide the key 37 and the side members 44 and 46 when the key safe is in a closed position. This construction also creates a weather proof housing for the hidden key. The facade can be maintained in the closed position by frictional forces between the pair of side structures for any type of latch or catch mechanism which may by molded along with facade 12 and securing portion 42 as shown.

Pulling on the facade in the direction of arrow 60 shown in FIG. 5 will release the facade from the securing portion to reveal the hidden key or object.

Because hinge 25 is located at the top of facade 12 and the top of securing portion 42 and positioned in the relative middle thereof parallel tubes 14 and/or portions of parallel tubes 14 can be removed from either end of the key safe so that a first mass marketed key safe can be costumed tailored so that it does not resemble a second such object.

The key safe of this embodiment is also preferably constructed in one piece by injection molding.

FIGS. 6 and 7 show a third embodiment of the invention. In this third embodiment the facade 12 of the key safe 10 resembles the nest of a paper wasp. As clearly seen in FIG. 6 the key safe 10 includes a base or securing portion 51 which is a first leaf of hinge 25. The securing portion 51 can be fastened, for instance, to the overhang of a deck or house, preferably within reasonable reach, by a fastener or a screw 53 as shown. An S-shaped hook 34 is also positioned on the support surface for receiving a key 37 or other small object and a female closure member 54, more clearly shown in FIG. 7, can be positioned to the right side of hook 34.

The facade 12, which resembles the nest of a paper wasp functions as a second leaf of hinge 25. Positioned on the rim of the facade, as shown in both FIGS. 6 and 7, is a male closure member 58. The interior of facade 12 is hollow, so that when the facade is closed by a force applied in the direction of arrow 60 shown, and the key is positioned simultaneously by a free hand against the securing portion and the free hand is removed and pressure is continually applied to the face to force the mating of the closure members, the key is hidden by the facade. In the closed position the key is retained in the hidden position.

The cells 64 shown on the facade 12 of this third embodiment may be selectively removed by a razor blade or the like, to tailor the device. Alternatively score lines can be provided to surround a section of cells so that whole sections may be removed.

It should be apparent that many modifications may be made to the invention without departing from the spirit and scope of the invention. Therefore, the drawings and the embodiments disclosed are only used for illustration and direction. The invention is limited only in scope by the appended claims.

What is claimed is:

1. A device for hiding small objects comprising:

an olefin polymer facade resembling the nest of a stinging insect, the facade forming at least a portion of a hollow interior for receiving the small object;

means for retaining the small object within the hollow interior; and means integral to the facade for fastening the device to an exterior surface above the ground.

2. The device of claim 1 wherein the facade resembles a nest of a mud dauber wasp.

3. The device of claim 1 wherein the facade resembles the nest of a paper wasp.

4. A device for hiding small objects comprising:

a facade resembling the nest of a stinging insect, the facade forming at least a portion of a hollow interior for receiving the small object;

means integral to the facade for fastening the device to an exterior structure above the ground; and a hook fastened to said means integral to the facade, for retaining the small object within the hollow interior.

5. A device for hiding small objects comprising:

an exterior facade resembling the nest of a stinging insect and forming at least a portion of a hollow interior;

a flat hinge having a first and second leaf, the first leaf being integrally connected to the reverse side of the exterior facade, the second leaf being used to mount the device to a support structure; and means for hanging a small object within the hollow interior of the device, the small object being hidden by the facade.

6. The device of claim 5 wherein the first and second leaves possess locking and unlocking mating closure members.

7. The device of claim 6 wherein the facade resembles the nest of a mud dauber, and the facade is composed of a plurality of tubes wherein at least one of the tubes is easily removable to distinguish the facade from other mass manufactured goods.

8. The device of claim 7 wherein said means for hanging a small object is a hook.

9. The device of claim 6 wherein the facade resembles a mud dauber's nest having a plurality of tubular sections.

10. The device of claim 9 including score lines located between at least two tubular sections for the removal of at least one of the tubular sections.

11. A device for hiding small objects comprising:

an exterior facade resembling the nest of mud dauber wasp and forming at least a portion of a hollow interior;

a hinge having first and second leaves, the first leaf being integrally connected to the reverse side of the facade, and defining an opening for access to the hollow interior, said second leaf having means for mounting the device to a support structure;

a hook fastened to the face of the second leaf for retaining a key; said key being retained in the interior of the facade when the two leaves of the hinge are in a closed position.

12. The device of claim 11 wherein the first and second leaves have means for maintaining the facade in a locked position when the leaves of the hinge are in a closed position.

13. The device of claim 11 including score lines located between at least two tubular sections for the removal of at least one of the tubular sections.

14. A device for hiding small objects, comprising:

a facade resembling the nest of a stinging insect, the facade forming at least a portion of a hollow interior for receiving the small object, said facade having a reverse side;

a hinge positioned on an edge of the facade;

a securing portion having a front face and connected to the hinge, said facade and securing portion functioning as the leaves of the hinge; and structural means positioned on the reverse side of the facade and the front face of the securing portion creating a storage area for the small object when the hinge is in a closed position.

15. The device of claim 14 wherein the facade resembles the nest of a mud dauber.

16. A man-made device for hiding small objects comprising:

a facade resembling the nest of a stinging insect, the facade forming at least a portion of a hollow interior for receiving the small object;

means for retaining the small object within the hollow interior; and means integral to the facade for fastening the device to an exterior surface above the ground.

17. The device of claim 1 wherein the olefin polisher is selected from the group consisting of polyethylene, polypropylene and mixtures thereof.

18. The device of claim 16 wherein said facade is made of an olefin polymer.

19. A device for hiding small objects comprising:

a polymerized plastic facade resembling the nest of a stinging insect, the facade foxing at least a portion of a hollow interior for receiving the small object;

means for retaining the small object within the hollow interior; and means integral to the facade for fastening the device to an exterior surface above the ground.

20. The device of claim 19 wherein the polymerizable plastic is selected from the group consisting of polyethylene, polypropylene and mixtures thereof.

* * * * *